US005195220A

United States Patent [19]

Herman

[11] Patent Number: 5,195,220

[45] Date of Patent: Mar. 23, 1993

[54] DECORATIVE AND AESTHETIC MULTI-PART BUCKLE FOR BELTS AND THE LIKE AND THE FABRICATION THEREOF

[75] Inventor: Michael Herman, Huntington, N.Y.

[73] Assignee: Herman Pearl Button Co., Inc., New York, N.Y.

[21] Appl. No.: 847,760

[22] Filed: Feb. 28, 1992

Related U.S. Application Data

[63] Continuation-in-part of Ser. No. 805,321, Dec. 10, 1991.

[51] Int. Cl.[5] ..... A44B 11/00

[52] U.S. Cl. ..... 24/163 R; 24/113 MP; 24/163 K

[58] Field of Search ..... 24/163 K, 163 R, 163 FC, 24/113 MP, 265 WS, 49 K; 63/29.1; 224/163

[56] References Cited

U.S. PATENT DOCUMENTS

| | | | |
|---|---|---|---|
| 336,062 | 2/1886 | Palmer | 24/113 MP |
| 2,634,476 | 4/1953 | Mishkin et al. | 24/163 FC |
| 2,798,389 | 7/1957 | Sackrider | 24/163 FC |
| 3,237,262 | 3/1966 | Decker | 24/163 FC |
| 3,969,836 | 7/1976 | DuBois | 24/163 K |
| 4,384,390 | 5/1983 | Hayakawa | 224/163 |
| 4,665,591 | 5/1987 | Servay | 24/163 K |

FOREIGN PATENT DOCUMENTS

| | | | |
|---|---|---|---|
| 0671459 | 2/1966 | Belgium | 24/163 R |
| 2950547 | 6/1981 | Fed. Rep. of Germany | 24/163 K |
| 1050590 | 1/1954 | France | 24/113 MP |
| 2289136 | 7/1976 | France | 24/113 MP |
| 0238894 | 11/1945 | Switzerland | 63/29.1 |
| 0464313 | 4/1937 | United Kingdom | 224/163 |
| 0687155 | 2/1953 | United Kingdom | 24/163 R |
| 2181939 | 5/1987 | United Kingdom | 24/163 K |

*Primary Examiner*—Victor N. Sakran
*Attorney, Agent, or Firm*—Richard S. Roberts

[57] ABSTRACT

Rib and groove snap-type action securing elements are formed respectively on buckle bases and caps so that a number of different buckle caps can be disposed for co-action with a single base to fabricate a number of different buckle assemblies. In one embodimenmt the rib is carried by a depending circumferential wall of the cap for co-action with a circumferential groove formed in the base, while in another embodiment the rib is carried by an upstanding circumferential wall of the base for co-action with a groove disposed peripherally about the cap. In other embodiments a disk-like intermediate cap is disposed between a base and a top cap formed with a surrounding depending wall with a bead along its lower edge for co-action with the lower edge of the base. In yet another embodiment the intermediate member is also formed with a depending circumferential wall terminating in a circumferential bead which co-acts with a lower edge of the base and with a groove on its outer surface that co-acts with a bead proximate the lower edge of the top cap. In yet another embodiment the cap includes a pair of parallel disposed ribs one for co-action with a disc-like intermediate cap and one for co-action with the base member.

37 Claims, 9 Drawing Sheets

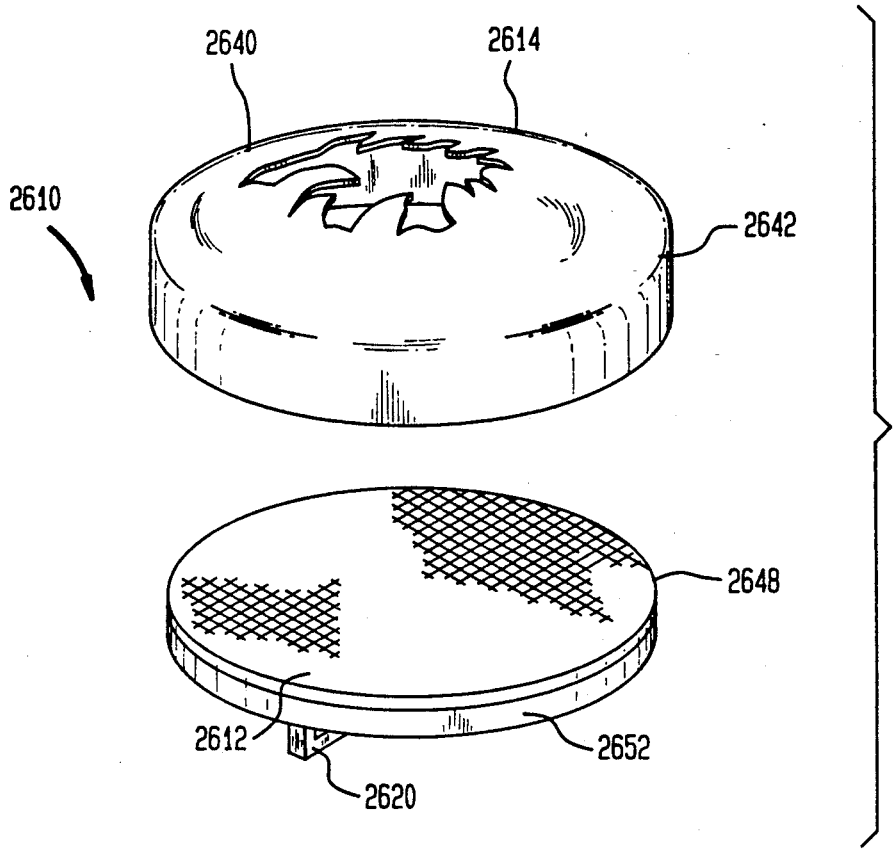
FIG. 15
FIG. 16
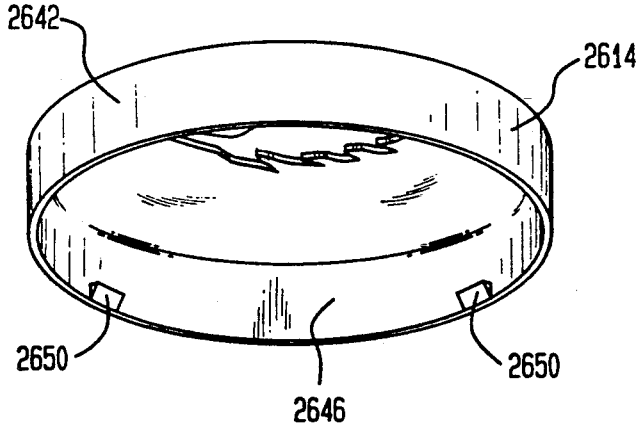
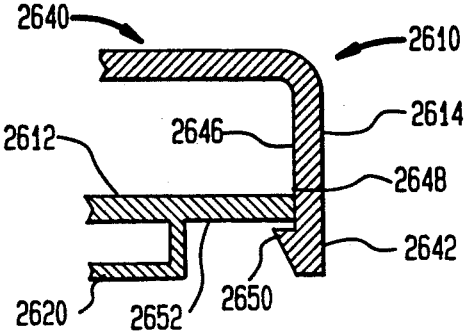
FIG. 17

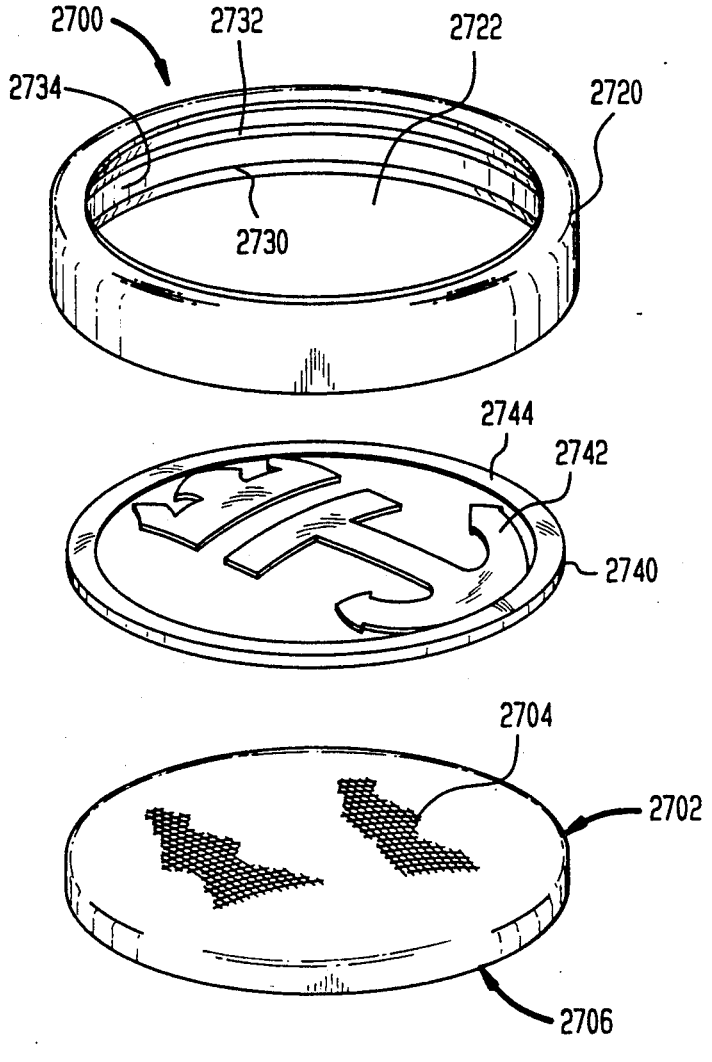
FIG. 18
FIG. 19
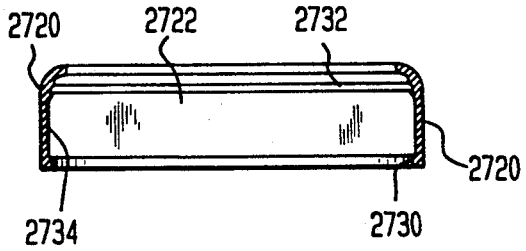
FIG. 20
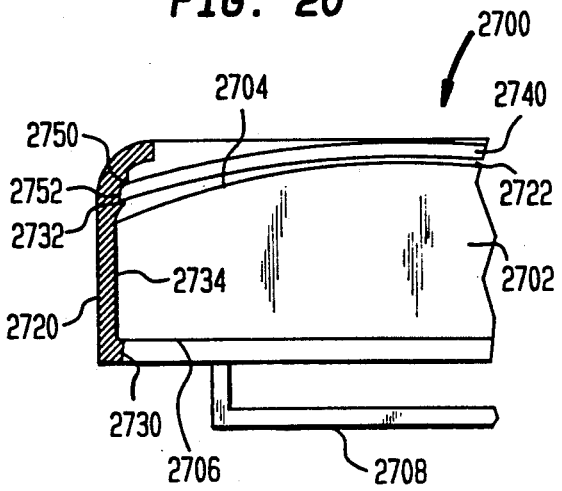

DECORATIVE AND AESTHETIC MULTI-PART BUCKLE FOR BELTS AND THE LIKE AND THE FABRICATION THEREOF

CROSS REFERENCE TO RELATED APPLICATION

This application is a continuation in part of U.S. Pat. application Ser. No. 07/805,321 filed Dec. 10, 1991, which is incorporated herein by reference.

BACKGROUND OF THE INVENTION

This invention relates to buckles; and more particularly to multi-part buckles for belts and the like.

Buckles are mainly used as the device or mechanism that secures two ends of a belt or strap together, generally in a relatively variable way, so as to encircle a person's waist and accommodate the girth of that waist which may vary somewhat on a particular day and from day to day. If a particular person's waist increases or decreases over time by more than a particular amount then a new belt or strap with a new buckle or which can accommodate the same buckle may be required.

Buckles, while widely used for belts, straps and the like, are also used as decorative ornaments for shoes and on fabric hangings, as adjustments devices for carrying straps and for many other purposes.

The general construction of a buckle usually requires some form of mechanism, clasp or device for attaching the buckle to its belt, strap, hanging, etc., and, if needed, to receive and permit variable adjustments of the belt, strap or the like; as well as an observable portion presented to the viewer. If the buckle is to be worn on garments as part of a belt or on articles of clothing such as shoes, the functional part of the buckle, i.e. the attaching and adjustment mechanism is disposed towards and against the wearer while the observable portion is disposed on the opposite side of the buckle and faces away from the wearer. Similar positioning of the buckle parts would be usual for other buckle uses.

Many buckles are merely functional with not much of and attempt made to provide a decorative observable face, such as the clasp shown and described in U.S. Pat. No. 1,698,530. Other buckles seek to present a pleasing and aesthetically ornamented or decorated face such as that shown and described in U.S. Pat. No. 1,125,023, but the letter ornamentation is secured in place.

In many instances the functional parts of buckles, i.e. the part for attaching the buckle to its belt, strap, sash, hanging, etc., are alike and somewhat universal; whether the buckle is to be permanently affixed to its belt, strap, etc., or whether it is to be mounted to the buckle for ready removal therefrom for attachment to another buckle. It is the face construction of the buckle that changes, especially when ornamented and decorated buckles are desired. However, for most buckles, the functional back side and aesthetic front or face are integrally formed in a unitary manner requiring the buckle manufacturer to fabricate and store many fully fabricated buckles.

Some available buckles, such as those shown in U.S. Pat. Nos. 1,995,713 and 3,091,141 are merely cloth covered and force or press fit together. The variation in the observable or face portion of this type of buckle resides only in the different types of fabric covering. The assembly of the buckle parts is only a press or force fit one which may pop apart because there is no positive structure holding the buckle parts together. Other buckles merely display a sheet card or picture such as shown and described in U.S. Pat. Nos. 1,784,794 and 4,170,808. But these buckles merely provide a shallow face area on the buckle within which a relatively thin and flat sheet, card or photo may be displayed. U.S. Pat. No. 3,864,791 also merely provides a window like belt buckle face but one within which a different but still relatively flat and thin decoration, such as a piece of fabric, may be displayed. U.S. Pat. No. 744,995 shows a different kind of buckle, i.e. one for use with suspenders or braces, but which includes a hinged and snap fastened hidden compartment that also is sized and configured for relatively thin and flat objects like pictures or money. Such objects do not contribute to the aesthetics of the buckle since they are in a hidden compartment which is not otherwise ornamented or decorated.

U.S. Pat. Nos. 4,052,773 and 4,972,557 on the other hand, provide buckles which display ornamentations, i.e. an initialed plate for a buckle. Such buckle structures retain the decorative item in place by springy elements to permit ready changeability by the user. Loss of the springy retaining part will prevent further use of the buckle. Structure such as these which are relatively easy to assemble and disassemble may also be undesirable because the integrity of the securing structure may wear and fail rendering the buckle no longer usable.

SUMMARY OF THE INVENTION

The present invention provides a buckle assembly comprising:

(a) buckle base means including attaching means for securing said buckle base means to a belt, strap, sash or the like; and (b) buckle cap means for co-action with and mounting to said buckle base means; and (c) said buckle base means and said buckle cap means together carrying said securing means for non-removably securing said buckle base means and buckle cap means together into a buckle assembly, said securing means including securing elements which readily co-act to secure said buckle base means and buckle cap means together and which prevent separation of said buckle base means and said buckle cap means.

The invention also provides a method of producing a buckle assembly comprising:

(a) providing buckle base means including attaching means for securing said buckle base means to a belt, strap, sash or the like; and (b) providing buckle cap means for co-action with and mounting to said buckle base means; and (c) said buckle base means and said buckle cap means together carrying said securing means for non-removably securing said buckle base means and buckle cap means together into a buckle assembly, said securing means including securing elements which readily co-act to secure said buckle base means and buckle cap means together and which prevent separation of said buckle base means and said buckle cap means; said securing elements comprise one or more raised chevron shaped wedge members positioned about an internal or external perimeter wall of said buckle cap means or said buckle base means, and oppositely, a plurality of complementary recessed chevron shaped wedge members positioned about an external or internal perimeter wall of said buckle base means or said buckle cap means whichever does not have the raised chevron members, said raised chevron members and said recessed chevron members being capable of a snap-together engagement with one another, which engagement substantially prevents the movement of said buckle cap means with respect to said buckle base means; and d) snapping together said buckle base means and said buckle cap means and engaging said complementary recessed and raised chevron members.

It is an object of this invention to provide improved multi-part ornamented buckles wherein a single buckle base member accepts, during fabrication of the buckle, a number of different caps or covers or pieces which may be decorative, which once secured to the buckle base member cannot separate therefrom.

Other object, features, and advantages of the invention in its details of construction and arrangement of parts will be seen from the above and from the following description of the preferred embodiments when considered with the drawing and the detailed description of the preferred embodiments.

BRIEF DESCRIPTION OF THE DRAWINGS

In the drawings:

FIG. 15 is an exploded perspective view of another buckle assembly incorporating the instant invention.

FIG. 16 is a perspective view of the cap or cover for the buckle assembly of FIG. 15, looking in from the bottom to better show details thereof.

FIG. 17 is an enlarged sectional view of a portion of the cover for the assembly of FIG. 15 showing one of the latching elements of the buckle assembly of FIGS. 15 and 16.

FIG. 18 is an exploded perspective view of yet another buckle assembly incorporating the instant invention.

FIG. 19 is a vertical sectional view of the cover for the buckle assembly of FIG. 18.

FIG. 20 is a vertical sectional view of a portion of the cover of FIGS. 18 and 19 enlarged to better show details thereof.

DESCRIPTION OF THE PREFERRED EMBODIMENTS

Figure 1:
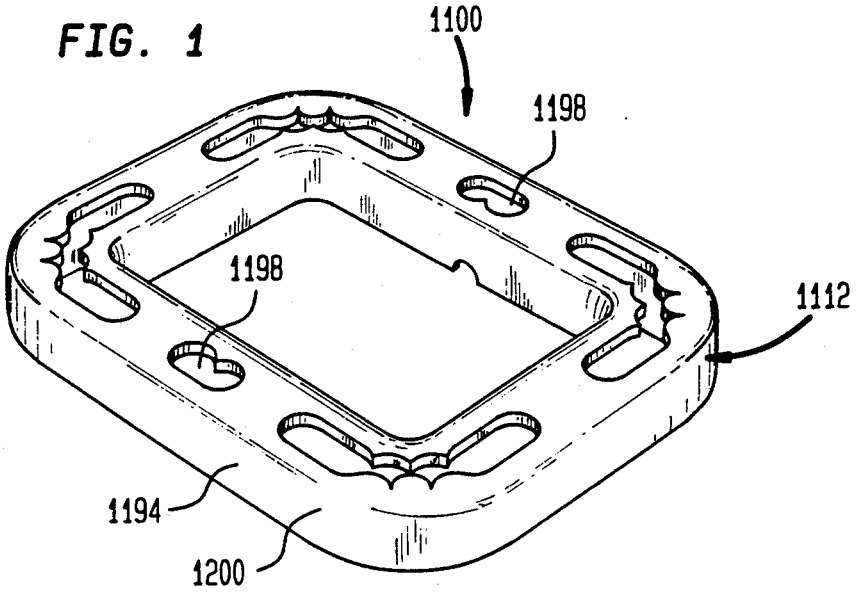
FIG. 1 is a perspective showing of a buckle assembly incorporating the instant invention.
Figure 2:
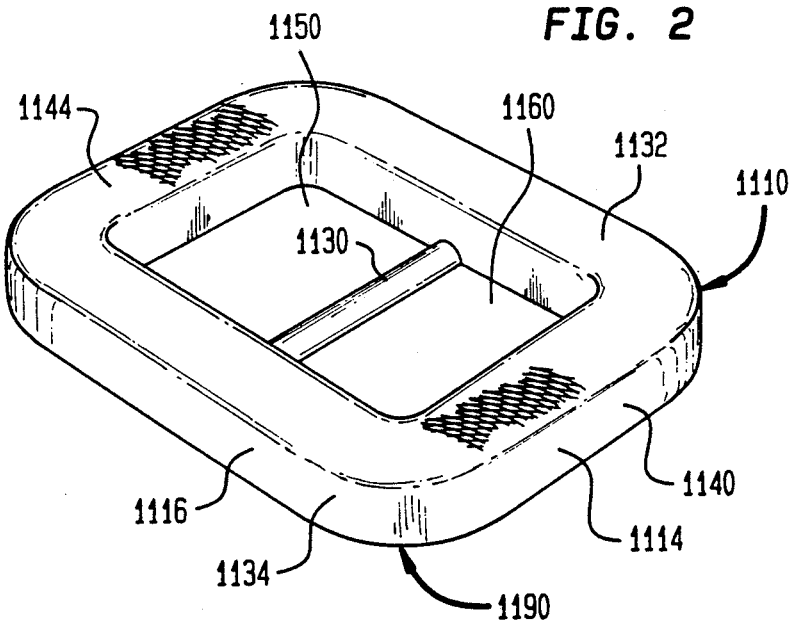
FIG. 2 is a perspective showing of base member for the buckle assembly of FIG. 1.

With reference to FIG. 1 there is generally shown at 1100 a buckle assembly including a buckle base member 1110 (FIGS. 1 and 2) and a buckle cap member 1112 (FIGS. 1 and 3) all incorporating the instant invention. Buckle base member 1110 (FIG. 2) is fabricated to include a frame 1114 upon which, in this instance, a covering of fabric 1116 is applied and secured. Base member 1110 is, in the illustrated example, substantially rectangular in configuration with rounded corners and of particular thickness. Other configurations, thicknesses, sizes and constructions may just as well be used for buckle base 1110.

A cross-bar 1130 spans opposite sides 1132, 1134 of buckle base member 1110 and with sides 1132 and 1134 and other sides 1140, 1144 defines two openings 1150, 1160. Cross-bar 1130 serves as an attachment place for a belt, strap or the like (not shown) which may be secured thereabout permanently as by rivets or the like or interchangeably as by snaps or the like in conventional manners. Openings 1150, 1160 serve in conventional way as receptacles for the strap or belts other end when the belt or strap is worn.

Figure 3:
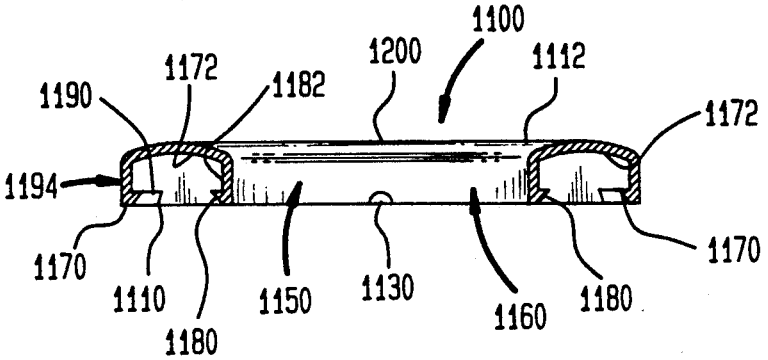
FIG. 3 is a vertical sectional view of the buckle assembly of FIG. 1.

Buckle cover or cap member 1112 is fitted over and fixedly secures to buckle base member 1110 as shown with reference to FIG. 3. A circumferential rib 1170 surrounds and extends out from an interior surface 1172 of buckle cap or cover 1112, while another circumferential rib 1180 surrounds and extends out from an opposite interior surface 1182 of buckle cover or cap 1112. Ribs 1170, 1180 may be continuous or discontinuous and form either a unitary or a plurality of latching elements disposed in spaced relationship about inner surfaces 1172, 1182 of cap or cover 1112. Whether continuous or discontinuous ribs 1170, 1180 are disposed and sized to snap over buckle base member 1110 and be positioned beneath and in proximate and co-acting relationship with a bottom surface 1190 of buckle base member 1112. The walls 1194 of buckle cap or cover member 1110 are fabricated from metal or plastic stock to be somewhat flexible to facilitate snapping of buckle cover member 1112 over buckle base member 1110 and the positioning of ribs 1170, 1180 beneath bottom surface 1190 of buckle base member 1110.

Buckle cap or cover member 1112 may have punch outs 1198 (FIG. 1) formed therethrough to provide an aesthetically pleasing design and/or it may have its surface 1200 otherwise decorated and/or ornamented. Cap or cover member 1112 may be fabricated from precious metals such as gold, silver or the like, from non-precious metals such as brass, copper, etc., from plastic or from any suitable substance or material. Buckle base member 1110 may or may not be fabric covered. It may be fabricated from suitable plastic or the like and may or may not have its surfaces decorated or ornamented. The treatment of the surface of base member 1110, when cap or cover member 1112 is formed with openings 1198, will be observable.

It is an important feature of this invention that the buckle cap and buckle base members of the assembly be substantially permanently and non-removably attached to one another once they are snapped together. This means that once these parts are united, essentially the only way they can be separated again would be to physically break them apart s that they would subsequently be non-usable, i.e. not re-attachable. This is important since if an item readily disassembles, consumers would find it unacceptable. For example, if a buckle on a garment comes apart either in a store, or in use, the customer would find that entire garment to be unacceptable. Hence readily detachable buckles would be flimsy and not commercially viable. An important feature of this invention is that the ornamentation assemblies must be non-removable once attached. In the preferred embodiment, this non-removable attachment is achieved in the absence of adhesives. In a more preferred embodiment, the ornamentation elements are also non-rotatable with respect to one another and in the most preferred embodiment, the elements are substantially not movable at all with respect to one another.

The buckle assembly construction thus permits use of a single buckle base member with many different cap members and facilitates the availability of a variety of buckles to a manufacturer of buckles for belts, straps, sashes, etc., which utilize such buckles, while at the same time minimizing the number of items in inventory by reducing the number of buckle bases for making such buckle assemblies.

Figure 4:
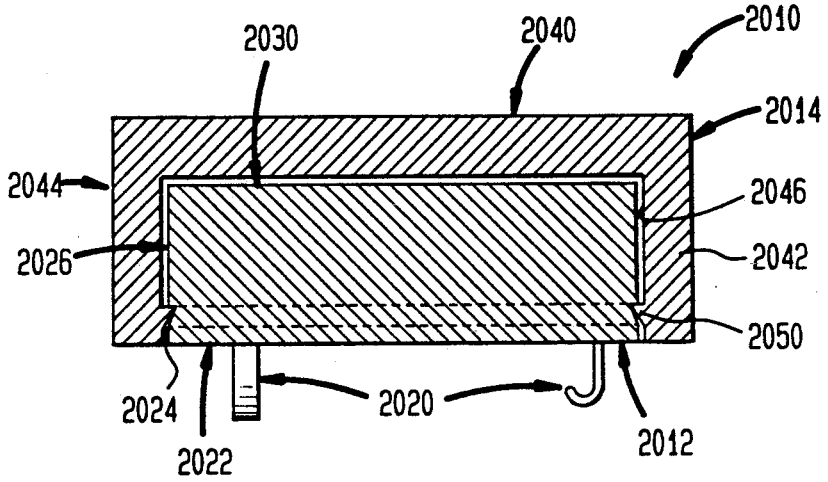
FIG. 4 is a vertical section through an alternative embodiment of buckle assembly incorporating the instant invention and enlarged to better show details thereof.

FIG. 4 shows at 2010 an alternative buckle assembly including a buckle base member 2012 and a buckle cap member 2014 all incorporating the instant invention. Buckle base 2012 is fabricated from materials conventionally utilized to fabricate buckles such as plastic, metal, wood, bone or the like and includes a conventional belt attachment 2020 suitably an conventionally secured to and extending from an underside 2022 of buckle base 2012. Attachment 2020 is of a size, configuration and disposition to receive and co-act with both ends of a belt, strap, sash, or the like—a first end of which is to be secured in a conventional manner to the buckle assembly base member and the other end of which is to co-act with the buckle base member as the belt, strap or the like is adjusted in position during use. A groove 2024 is formed in a side surface 2026 of buckle base 2012 and extends around the periphery and circumference of buckle base 2012 at a predetermined location between underside 2022 and a top 2030 of buckle base 2012. The circumferential configuration of buckle base 2012 may be circular, oval, square or any other conventional configuration. If desired, groove 2024 may be discontinuous.

Buckle cap member 2014 includes an upper surface 2040 and side wall 2042 including a side surface 2044 depending therefrom thus forming a cap-like member. Surfaces 2040 and 2044 may, if desired, be decorated with any desired motif, surface texture, color, or other aesthetic design or configuration. Side wall 2042 includes an inner surface 2046 having an open configuration corresponding to the circumferential configuration of side surface 2026 of buckle base 2012. An outwardly extending rib 2050 extends about inner surface 2046 of side wall 2042 at a location thereon to co-act with groove 2024 of buckle base 2012. Rib 2050 may be discontinuous or continuous and is formed discontinuous if groove 2024 is so formed and so as to correspond to and co-act with groove 2024.

At least side wall 2042 of buckle cap member 2014 is formed to be resilient and so that it can snap over buckle base 2012 so its rib 2050 will snap into and co-act with groove 2024 to secure buckle cap member 2014 to buckle base 2012. The resilience of side wall 2042 and the co-action of rib 2050 and groove 2024 is selected to permit relatively easy assembly of buckle cap member 2014 and buckle base member 2012 but not permit disassembly thereof.

The size and configuration of member 2012 and its decorative portion 2014, would be selected to provide the size and configuration appropriate to the type and kind of buckle.

Attaching structure 2020 would be modified to the size and kind of belt, sash, or the like to be used with the buckle 2010.

Figure 5:
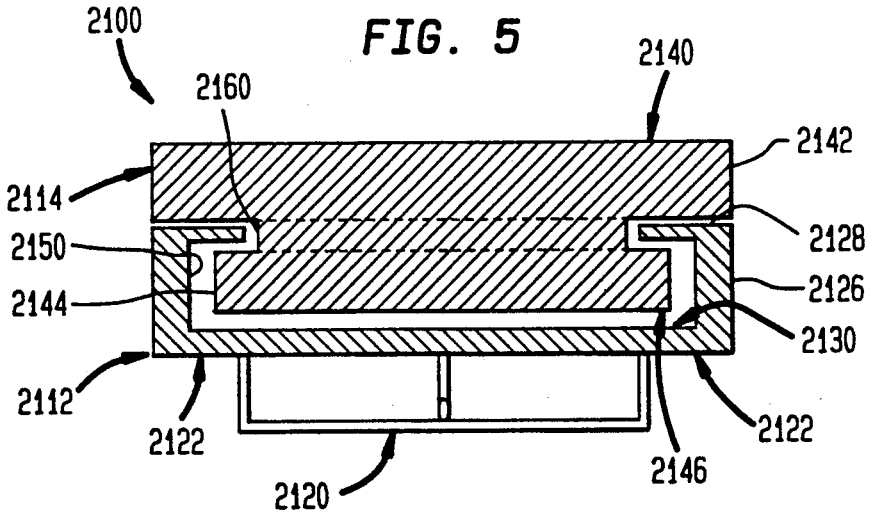
FIG. 5 is a vertical section through another alternative buckle assembly construction incorporating the instant invention enlarged to better show details thereof.

FIG. 5 shows still another buckle assembly 2100 including a buckle base member 2112 and a buckle cap member 2114 all incorporating the instant invention. Buckle base member 2112, like buckle base member 2012 of the FIG. 4 embodiment, is fabricated from materials conventionally utilized to fabricate buckles and includes a belt attaching structure 2120 suitably and conventionally secured to and extending from an underside 2122 of buckle base member 2112. Attaching structure 2120 is of a size, configuration and disposition to receive the belt, sash strap, etc., to be utilized with buckle assembly 2100.

Buckle base member 2112 is generally cup shaped and further includes an upwardly extending side wall 2126 about its periphery terminating in an in-turned lip or rib 2128 disposed at a predetermined height above a surface 2130 of buckle base member 2112. The circumferential configuration of buckle base member 2112, like that of buckle base 2012 of FIG. 4, may be circular, oval, square, rectangular or any other conventional configuration. If desired lip or rib 2128 may be discontinuous.

Buckle cap member 2114 includes an upper surface 2140, upper side wall 2142, lower side wall 2144 and a lower surface 2146. Surface 2140 and the surface of upper side wall 2142 may, if desired, be decorated with any selected motif, surface texture, color, or other aesthetic design or configuration. The surfaces of lower side wall 2144, and if desired upper side wall 2142, are fabricated with a peripheral or circumferential configuration corresponding to that of side wall 2126 of buckle base member 2112; with the peripheral configuration of lower side wall 2144 of reduced diameter to that of upper side wall 2142 and also corresponding to the internal peripheral configuration of lip 2128 and of an internal surface 2150 of side wall 2126 of buckle base 2112. The height of lower side wall 2144 is such that lower surface 2146 of buckle cap 2114 will not bottom against upper surface 2130 of buckle base member 2112.

A circumferential groove 2160 extends around the periphery of buckle cap member 2114 at the upper extremity of lower side wall 2144 thereof proximate upper side wall 2142. Groove 2160 may be continuous or discontinuous and if discontinuous along with lip 2128 is then groove will correspond to rib 2128 and co-act therewith as it will if groove 2160 is continuous.

At least side wall 2126 of buckle base member 2112 is fabricated or formed to be resilient and so that its lip or rib 2128 will receive and snap over lower side wall 2144 of buckle cap 2114 and into groove 2160 to co-act therewith and secure buckle cap member 2114 to buckle base 2112.

The resilience of side wall 2126 of buckle base member 2112 and the co-action of lip 2128 thereof with lower side wall 2144 and groove 2160 is selected to permit relatively easy assembly of buckle cap member 2114 and buckle base member 2112 but not permit ready disassembly thereof. Thus, the construction of the above described buckle assembly 2100, like that of buckle assembly 2010 of FIG. 4, permits use of a single buckle base member with many different buckle cap members and facilitates the availability of a variety of buckles to a manufacturer of articles which utilizes such buckles, while at the same time minimizing the number of items of inventory the manufacturer must stock by reducing the number of buckle base members for making such buckle assemblies.

The size and configuration of such base member 2120 and its decorative portion 2140 would be selected to provide the size and configuration appropriate to the type and kind of belt, strap or sash to be utilized with buckle assembly 2100.

Figure 6:
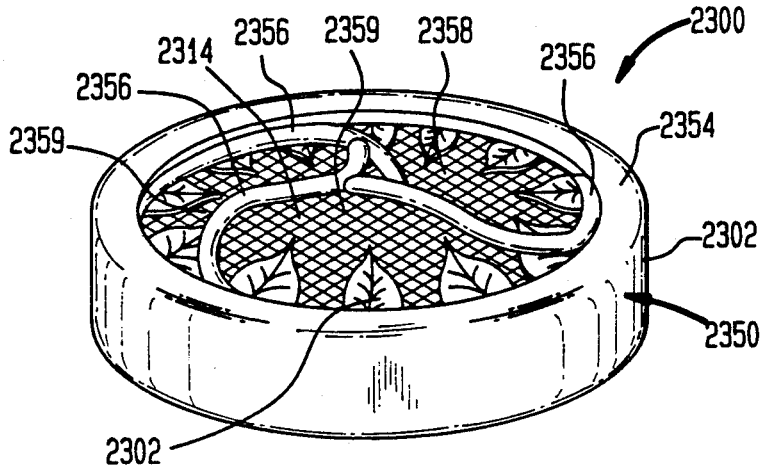
FIG. 6 is a perspective view of yet another alternative buckle assembly construction incorporating the instant invention and enlarged to better show details thereof.
Figure 7:
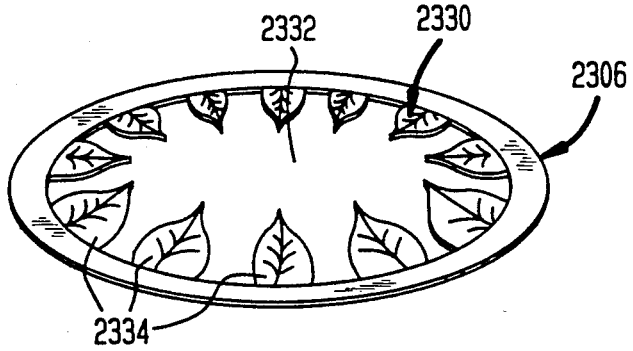
FIG. 7 a perspective view of an intermediate member of the assembly of FIG. 6.
Figure 8:
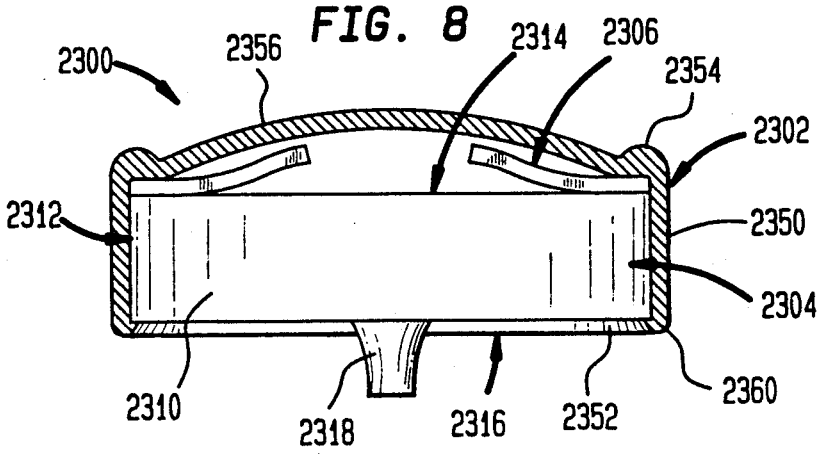
FIG. 8 is a vertical section through the assembly of FIG. 6.

FIGS. 6, 7 and 8 together show yet another embodiment of buckle assembly 2300 (FIGS. 6 and 8) incorporating the instant invention. A buckle cap member 2302 is formed to co-act with a buckle base member 2304 and with an intermediate buckle member 2306 (FIGS. 6–8) disposed therebetween as shown in FIGS. 6 and 8. Buckle cap member 2302, base member 2304, and intermediate member 2306 may be fabricated from conventional and available materials usually employed for making buckles as described for the buckle assemblies of FIGS. 1–5; with the material of buckle cap member 2302 being resilient for purposes to be hereinafter described.

Buckle base member 2304 includes a disc-like body 2310 (FIG. 8) having a side surface 2312, an upper surface 2314 and a lower surface 2316 from which extends an anchor or hook 2318 formed with an opening (not shown) to receive a fastening member such as a belt. At least upper surface 2314 of buckle base member 2304 may be decorated like the selected surfaces of buckle cap members 2014 and 2114 of the FIG. 4 and 5 embodiments, or if desired the entire body 2310 of base member 2304 may be covered by a fabric such as cloth, plastic, leather or the like.

Intermediate member 2306 is disc-like in that its peripheral configuration conforms to that of buckle base member 2304 and buckle cap member 2302. Intermediate member 2306 may be formed of relatively thin material dished upwardly as shown in FIGS. 7 and 8 and with a selected design 2330 cut therein and therethrough to form an opening 2332 and, if the design so employs, a number of leaf-like elements 2334 disposed thereabout. Opening 2332 may be centrally and systematically located with leaf-like elements 2334 disposed symmetrically thereabout or they may be non-symmetrically disposed and not centered, as desired, as long as there is an opening through intermediate member 2306 through which upper surface 2314 of buckle base member 2302 can be seen. Intermediate member 2306 also need not be dished as shown but may be just a relatively flat member.

Buckle cap member 2302 includes a ring-like side wall 2350 having a lower opening 2352 (FIG. 8) at its bottom, a circumferential rib 2354 (FIGS. 6 and 8) around its top edge, and a plurality of lace-like strips 2356 spanning an upper opening 2358 dividing same into a plurality of smaller openings 2359. A bead-like rib 2360 (FIG. 8) extends about the circumferential periphery of lower opening 2352 for co-action with buckle base member 2304 as will be hereinafter described. The height of side wall 2350 is selected so that bead 2360 thereof will snap beneath lower surface 2316 of buckle base member 2304, when base member 2304 is disposed within cap member 2302 (as shown in FIG. 8) and when intermediate member 2306 is disposed on upper surface 2314 of base member 2302 (all as shown in FIG. 8) and co-act with lower surface 2316 of base member 2304 and side wall 2312 thereof to secure buckle cap member 2302 and intermediate member 2306 together with buckle base member 2304 to form buckle assembly 2300. The resilience of at least side wall 2350 of buckle cap member 2302 permits a relatively easy snapping of ca member 2302 over base member 2304 and intermediate member 2306 and thus assembly of buckle 2300, but is not to permit ready disassembly thereof.

Leaf-like ribs 2356 may be of any desired thickness, configuration, disposition and number and need not necessarily completely span upper opening 2358, as long as there are sufficient smaller openings 2359 to view intermediate member 2306 and buckle base member 2302.

Buckle assembly 2300 thus permits use of a single buckle base member with many different intermediate and cap members to facilitate the availability of a large variety of buckles as described for the buckle assemblies of the FIGS. 1–5 embodiments.

The size and configuration of base member 2304 and its decorative portions 2302, 2306 would be selected to provide the size and configuration appropriate to the type and kind of buckle. Attachment 2318 would be sized to accommodate the size belt, strap, sash or the like.

Figure 9:
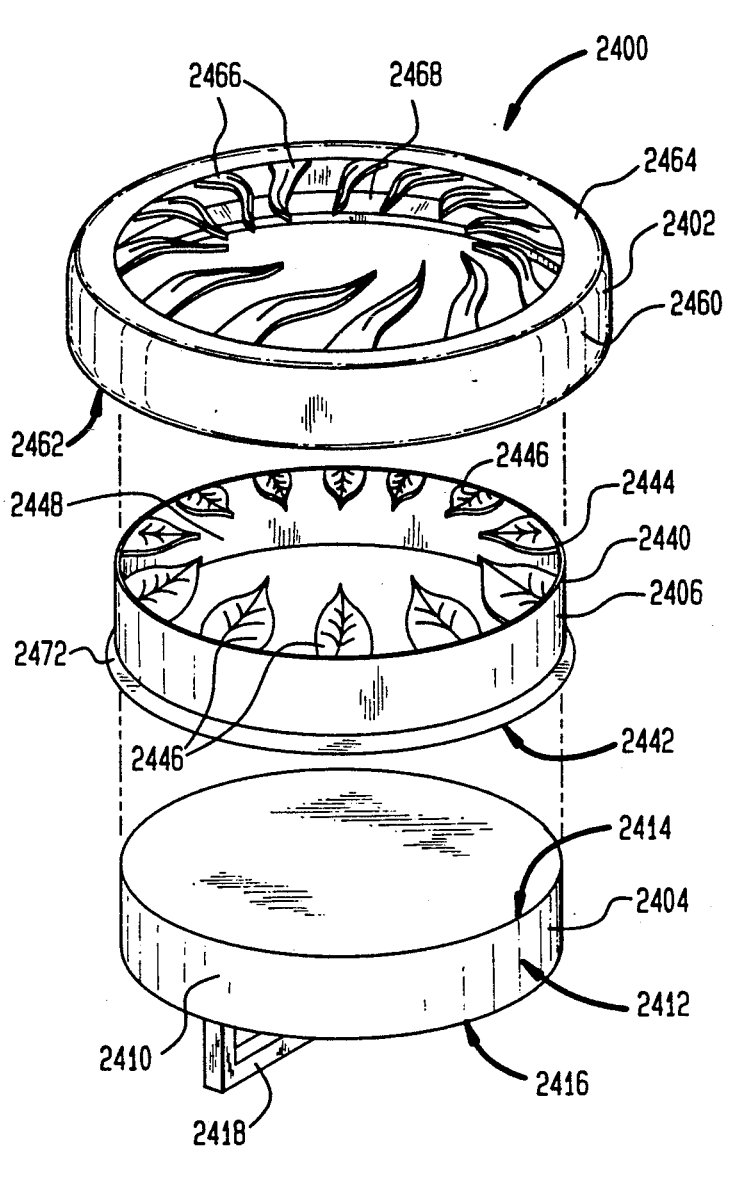
FIG. 9 is an exploded perspective showing of another alternative buckle assembly construction incorporating the instant invention, enlarged to better show details thereof.
Figure 10:
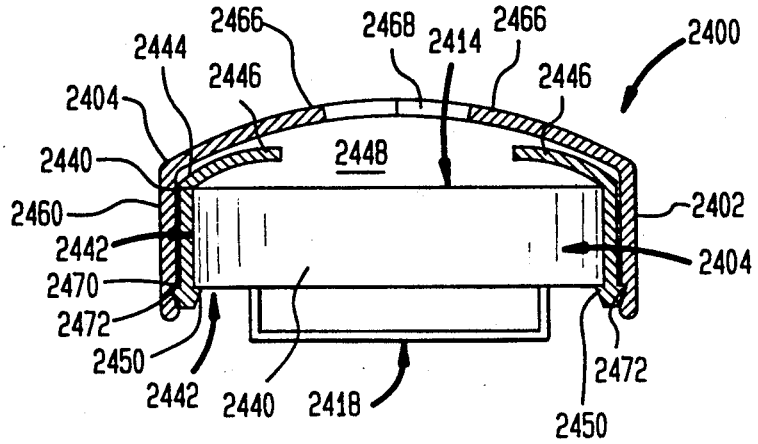
FIG. 10 is a vertical section through the assembled buckle assembly of FIG. 9, further enlarged to better show details thereof.

FIGS. 9 and 10 together show still another embodiment of buckle assembly 2400 incorporating the instant invention. A buckle top-cap member 2402 is formed to co-act with a buckle base member 2404 with a buckle intermediate-cap member 2406 disposed therebetween. Top-cap member 2402, base member 2404 and intermediate-cap member 2406 may be fabricated from conventional and available materials usually employed for making buckles as described for the other above described buckle assemblies; with the materials of buckle top-cap member 2402 and intermediate-cap member 2406 being resilient for purposes to be hereinafter described.

Buckle base member 2404 includes a disc-like body 2410 having a side surface 2412, an upper surface 2414 and a lower surface 2416 from which extends attaching structure 2418 formed to receive and co-act with a belt, strap, sash or the like. At least upper surface 2414 of buckle base member 2404 may be decorated like that of buckle base member 2314 of buckle assembly 2300 (FIGS. 6–8) or like buckle base member 2304 buckle base member 2404 may be covered by fabric such as cloth, plastic, leather or the like.

Buckle top-cap member 2402 and buckle intermediate-cap member 2406 are each cup-like and similar in configuration except that intermediate-cap member 2406 is of a size and configuration to snap over and co-act with buckle base member 2404 and top-cap member 2402 is of a size and configuration to snap over and co-act with both intermediate-cap member 2406 and buckle base member 2404.

Buckle intermediate-cap member 2406 includes a ring-like side wall 2440 having a lower opening 2442 (FIG. 10) at its bottom, a circumferential rib 2444 around its top edge and a plurality of leaf-like cut-out members 2446 extending into an upper opening 2448. A bead-like rib 2450 (FIG. 10) extends about the circumferential periphery of lower opening 2448 for co-action with buckle base member 2404 as will be hereinafter described. The height of side wall 2440 is selected so that bead 2450 thereof will snap beneath lower surface 2416 of buckle base member 2404, when buckle base member 2404 is disposed within intermediate-cap member 2406 as shown in FIG. 10, and will co-act with lower surface 2416 and side wall 2412 of buckle base member 2404 to secure intermediate-cap member 2406 in place.

Top-cap member 2402, like intermediate-cap member 2406, includes a ring-like side wall 2460 having a lower opening 2462 (FIG. 10) at its bottom, a circumferential rib 2464 around its top-edge and a plurality of leaf-like cut-out members 2466 extending into an upper opening 2468. A groove 2470 extends about the circumferential periphery of an inner surface of top-cap 2402 proximate lower opening 2448 for co-action with intermediate-cap member 2406 and buckle base member 2404 a will be hereinafter described. The height of side wall 2460 is selected so that groove 2470 thereof will snap onto an outer bead 2472 proximate a lower edge of side wall 2440 of intermediate-cap member 2406, as shown in FIG. 10, when top-cap member 2402 is disposed over intermediate-cap member 2406 and will co-act with same to secure top-cap member 2402 in place.

Leaf-like members 2446 of intermediate-cap member 2406 and 2466 of top-cap member 2402 may be of any desired thickness, configuration, disposition, and number and need not necessarily completely span their respective upper openings as long as there is sufficient open space through the tops of the cap members to view the intermediate-cap member leaf-like members through top-cap member 2402 and to view buckle base member 2404 through both cap members. If desired, the leaf-like members 2446, 2466 of either or both cap members may be replaced by cross-ribs as utilized for top member 2302 of FIG. 6.

Buckle assembly 2400 thus permits use of a single buckle base with many different top-cap and intermediate-cap members to facilitate the availability of a large variety of buckles as described for the buckle assemblies of the previously described embodiments.

The size and configuration of base member 2404 and its decorative portions 2402, 2406 would be selected to provide the size and configuration appropriate to the type and kind of belt, sash, strap, etc., to be utilized.

Figure 11:
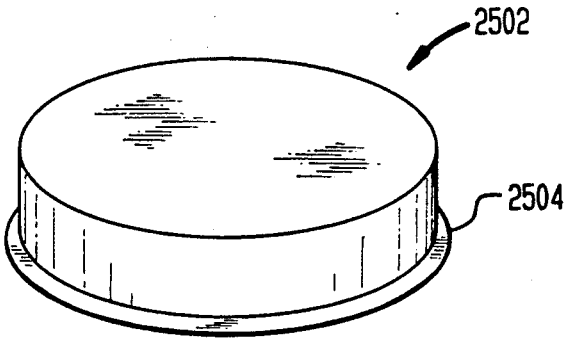
FIG. 11 is a perspective view of another alternative buckle assembly cap, incorporating the instant invention.
Figure 12:
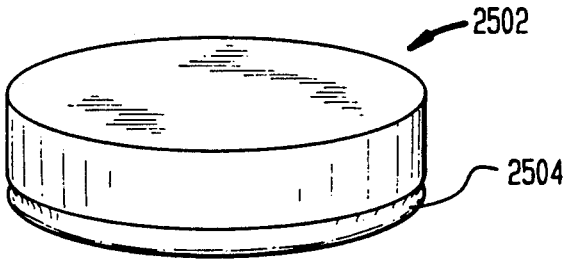
FIG. 12 another perspective view of the buckle cap of FIG. 8 with a manufacturing step performed thereon.
Figure 13:
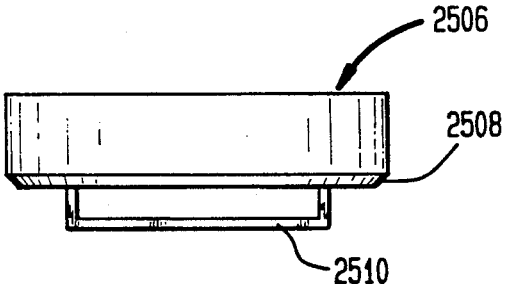
FIG. 13 a side view of a buckle base for the buckle cap of FIGS. 11 and 12.

FIGS. 11–13 show yet another embodiment of ornamentation in the configuration of a buckle cap 2502. Cap 2502 may be made, for example, of metal, such as brass or aluminum. Fitted along a free marginal edge of cap 2502 may be a grommet or collar 2504. Collar 2504 may be made of any suitable material, such as rubber or plastic. Collar 2504 may be substantially ring-shaped and may have a slit cut circumferentially (not shown) to admit the marginal edge of the cap 2502.

In the next step, the edge of the cap 2502 is bent inwardly (as in FIG. 12). A buckle base 2506 is of a similar construction to those disclosed hereinabove. A chamfer 2508 (FIG. 13) is formed at the lower or bottom portion of base 2506. On assembly, cap 2502 is forced over base 2506 and collar 2504 snapped into chamfer 2508 locking cap 2502 into position.

The size and configuration of base member 2506 and its decorative portion 2502, would be selected to provide the size and configuration appropriate to the type and kind of belt, sash, strap, etc., to be utilized for connection to clasp 2510.

Figure 14:
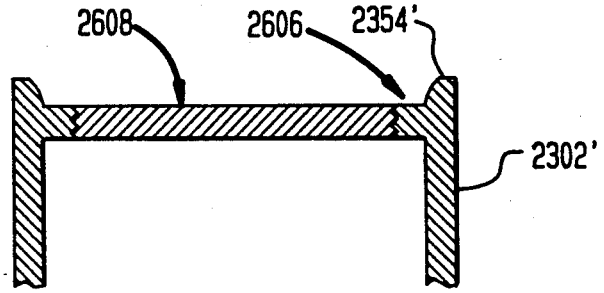
FIG. 14 a sectioned view of yet another buckle cap incorporating the instant invention.

It will also be understood that the cap (e.g., the cap of FIG. 7 or 9) may have a central portion internally threaded. Thus, as shown in FIG. 14, a cap 2302' may have a threaded opening 2606 formed in its top wall adjacent to its circumferential portion 2354'. A design-bearing top wall 2608 may then be threaded into the top. Once threaded into position, the consumer will not be aware that the design is inserted into the buckle. This assembly enables the manufacturer to employ any of a multiplicity of design elements to be used with a single shaped cap and base.

While the various ribs 2250, 2128, 2360, 2450 and 2472 of the respective embodiments of FIGS. 4, 5, 6-8 and 9-10 respectively have been shown as being continuous about the circumference of their respective members, they may just as well be discontinuous as long as there is sufficient rib to co-act with the respective grooves or base members to provide the desired and required secure attachment of caps and bases.

With reference to FIG. 15 there is generally shown at 2610 a buckle assembly including a buckle base member 2612 and a buckle cap member 2614 (FIGS. 15 and 16) all incorporating the instant invention. Buckle base 2612 (FIG. 15) is fabricated from materials conventionally utilized to fabricate buckles such as plastic, metal, wood, bone or the like and includes belt attaching structure 2620 (FIGS. 15 and 17) suitably and conventionally secured to and extending from an underside 2652 of buckle base 2612. Attaching structure 2620 is of a size, configuration and disposition to receive and function with a suitable belt, strap, sash or the like.

Buckle cap member 2614 includes an upper surface 2640 and side wall 2642 depending therefrom thus forming a cap-like member. Surfaces 2640 may, if desired, be decorated with any desired motif, surface texture, color, or other aesthetic design or configuration. Side wall 2642 includes an inner surface 2646 (FIGS. 16 and 17) having an open configuration corresponding to the circumferential configuration of side surface 264 (FIGS. 15 and 17) of buckle base 2612 a plurality of inwardly extending ribs or latching elements 2650 extend about inner surface 2646 of side wall 2642 at locations thereon to co-act with bottom surface 2652 of buckle base 2612. Latching elements 2650 are formed discontinuous and spaced about inner surface 2646 and so as to correspond to and co-act with bottom surface 2652 of buckle base 2612.

At least side wall 2642 of buckle cap member 2614 is formed to be resilient and so that it can snap over buckle base 2612 so that latching elements will snap beneath and co-act with bottom surface 2652 of buckle base 2612. The resilience of side wall 2642 and the co-action of latching elements 2650 with buckle base 2652 is selected to permit relatively easy assembly of buckle cap member 2614 and buckle base member 2612 but not to permit ready disassembly thereof.

The above described button assembly construction thus permits use of a single buckle base member with many different buckle cap members and facilitates the availability of a variety of buckles to a manufacturer of which utilizes such buckles, while at the same time minimizing the number of items in inventory by reducing the number of buckle bases for making such buckle assemblies.

FIGS. 18, 19 and 20 together show yet another embodiment of buckle assembly 2700 incorporating the instant invention. Buckle 2700 includes a base or body member 2702 (FIGS. 18 and 20) which is formed of suitable and appropriate material such as metal (gold, silver, etc.) plastic, wood or the like and having an upper surface 2704 which may or may not be decorated and a lower surface 2706 to which is secured belt attaching structure 2708 and appropriately sized and sizable.

A snap cover 2720 (FIGS. 18–20) is formed cap-like and of suitable metal, plastic or other materials and of a size and configuration to receive within an inside space 2722 provided therewithin to receive and co-act with base body member 2702. A pair of substantially parallel and spaced latching rings or ribs 2730, 2732 are formed within and extending from an inner surface 2734 of cover 2720. The lower ring or rib 2730 is configured and disposed to co-act with a lower surface of base 2702 to retain base 2702 and cover 2720 positioned one with respect to the other.

An insert 2740 (FIGS. 18 and 19) is formed of suitable material such as metal, plastic or the like and so as to provide a decorative effect when disposed between snap cover 2720 and base 2702 as shown in FIG. 20. Insert 2740 may be solid, or cut-out to form a design 2742 (FIG. 18) disposed within a circumferential ring 2744. Insert 2740 is sized and configured to be snapped in place within space 2722 of cover 2720 and to be secured in position by co-action of ring 2744 of insert 274 with latch ring or rib 2732 as shown in FIG. 20.

If desired, ring or rib 2732 may be formed to co-act with and be spaced from an upper ridge 2750 to define with rib 2732 a circumferential groove 2752 sized and configured to receive and secure in position circumferential ring 2744 of insert 2740. This construction will permit a pre-assembly of selected inserts 2740 and snap covers 2720 as a sub-assembly for later combination with base 2702.

Latch rings or ribs 2730, 2732 may be formed continuous as described or as discrete and discontinuous spaced members disposed about and extending from inner surface 2734 of snap cover 2720.

Buckle assembly 2700 thus permits use of a single base member 2702 with many different inserts 2740 and snap rings 2720 to facilitate the availability of a relatively large variety of buckles.

The assembly of FIGS. 18-20 shows a base 2702, a cover 2720 and a single insert 2740 which engages the inside of the cap. It is contemplated that one can provide several levels of similar inserts, each partially overlapping one another inside of the cap 2720 in a multilevel arrangement.

Figure 21:
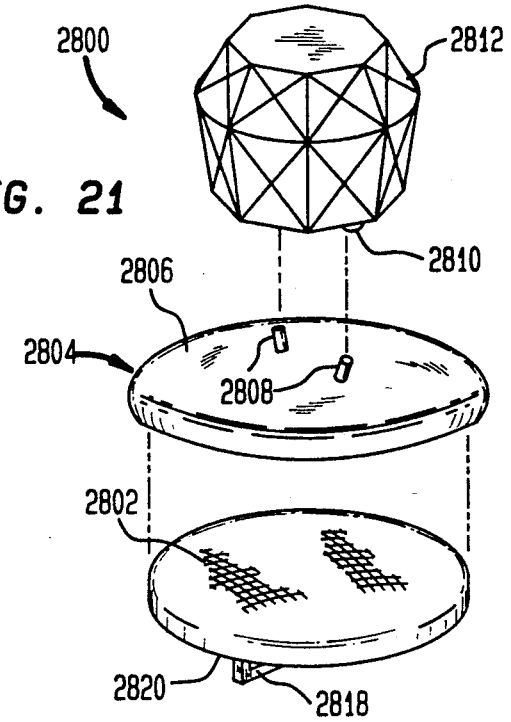
FIG. 21 is a schematic exploded showing of yet another alternative buckle construction incorporating the instant invention.

FIG. 21 shows yet another embodiment of buckle assembly 2800 incorporating the instant invention. A base member 2802 is formed of relatively plain and conventional material and into a configuration and size to receive and carry a cover member 2804 of a size and configuration to be received by and snap onto base member 2802 in a manner substantially identical to the co-action between the base and cap members of previously described embodiments. Cover member 2804 is formed from cloth covered or otherwise decorated and aesthetically pleasing ornamented material and so as receive on its surface 2806 a first half 2808 of a conventional snap type fastener the other half 2810 of which is carried by yet another element of ornamentation 2812. Ornamentation 2812 is smaller than cover member 2804 and snap type fastener halves 2808, 2810 are preferably disposed to position ornamentation element 2812 so as to be centered on cover member 2804. A non-centered disposition for ornamentation element 2812 on cover member 2804 may also be selected. A conventional pin or clasp 2818 is fixedly secured to a rear surface 2820 of base member 2802.

Figure 22:
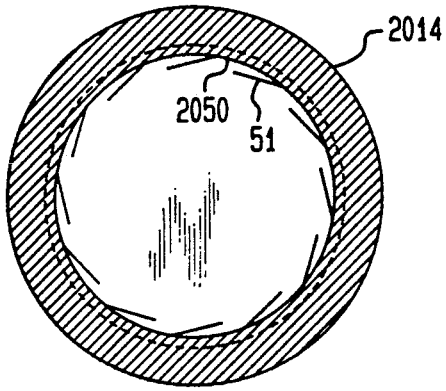
FIG. 22 shows a bottom cross-sectional view of another embodiment of the buckle previously described in FIG. 4 showing catches which prevent buckle cap rotation.

As heretofore described, the buckle cap and buckle base members, or combination buckle cap and buckle base with intermediate members are constructed in such a fashion that they are not removable from each other once assembled. Referring once again to FIG. 4 as one embodiment of this feature, once buckle cap 2014 is pressed onto buckle base 2012, rib 2050 slips into groove 2024. Rib 2050 and groove 2024 are fashioned so that they are not separable from one another. In one embodiment, the lower edge of rib 2050 may be rounded but the top edge may be flat so that it will not slip in an upward direction out of groove 2024. Alternatively, rib 2050 may hook into groove 2024 or into a channel within groove 2024. In another preferred embodiment, the groove of the buckle base member, or the buckle cap member as the case may be, may be provided with a series of stop catches to prevent rotation of the buckle cap with respect to the buckle base. FIG. 22 shows a bottom cross-sectional view of another embodiment of the cap 2014 previously described in FIG. 4. The cross section is made through rib 2050 which is provided with a series of fan-like projections 51 which catch the inside of groove 2024 and prevent rotation.

Figure 23:
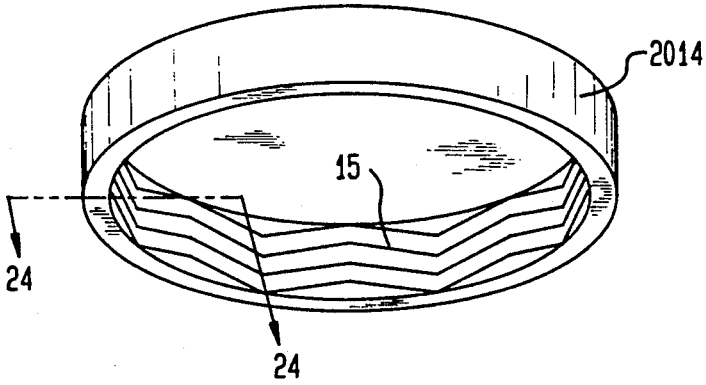
FIG. 23 shows a perspective view of another embodiment of the invention where the buckle cap member is provided with chevron shaped catches for cooperation with a base member.
Figure 24:
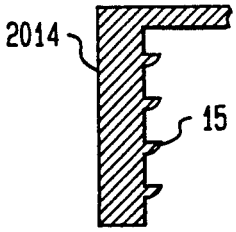
FIG. 24 shows a cross-sectional view of the buckle cap member of FIG. 23.
Figure 25:
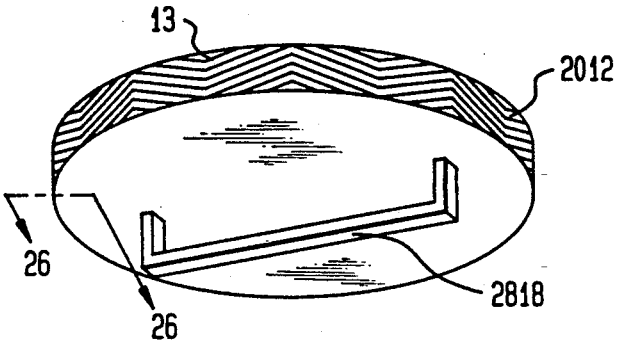
FIG. 25 shows a perspective view of another embodiment of the invention where the buckle base member is provided with chevron shaped catches for cooperation with a buckle cap member.
Figure 26:
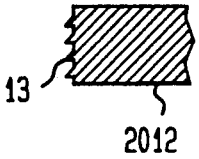
FIG. 26 shows a cross-sectional view of the buckle base member of FIG. 25.

FIGS. 23–26 show another embodiment of the invention where buckle cap member 2014 and buckle base member 2012 are provided with complementary chevron member 13 and 15 respectively. Buckle cap member 2014 is provided with several V-shaped recesses which snap together with V-shaped raised portions 13 on the buckle base member. Alternatively, the V-shaped raised portions can be on the inside of the buckle cap member 2014 and the recesses can be disposed on buckle base 2012. When the buckle cap and buckle base of FIGS. 23 and 25 are snapped together in a manner analogous to that of FIG. 4, the complementary chevrons engage and the buckle cap and buckle base are non-removably, non-rotatably and non-movably attached. FIGS. 24 and 26 show cross-sectional views along lines 24—24 and 26—26 respectively of the chevron configured members of FIG. 23 and 25.

Figure 27:
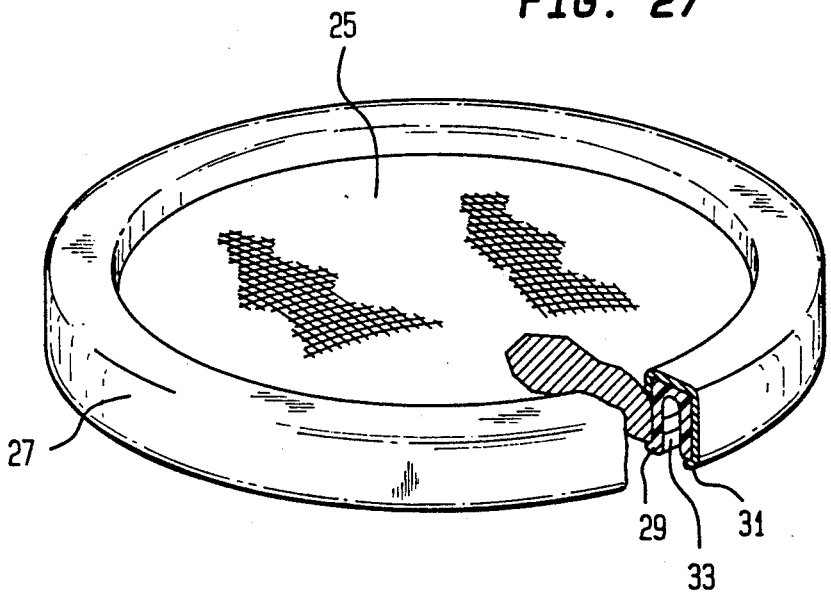
FIG. 27 a perspective view of another embodiment of a buckle cap member.

FIG. 27 shows another embodiment of the invention wherein a buckle cap member 25 is provided with a circumferential metal ring 27 around its outer periphery. Inside the ring is a plastic retainer 29. The retainer is held in place by a crimped over edge 31 of the metal ring. Inside of the retainer 29 is annular channel 33 which has either groove or rib means as previously described for cooperation with the complementary buckle base means. Similarly, this ring and retainer could be provided on the buckle base for cooperation and engagement with complementary buckle cap.

From the above description it will thus be seen that there has been provided new and novel buckle assemblies which are constructed from bases, caps and intermediate members which snap together in selected combinations to provide a large and wide variety of buckles and buckle assemblies from a small number of individual members in a simple and efficient manner.

It is understood that although I have shown the preferred forms of my invention that various modifications may be made in the details thereof without departing from the spirit as comprehended from the following claims.

What is claimed is:

1. A buckle assembly comprising:

(a) buckle base means including attaching means for securing said buckle base means to a belt, strap, sash or the like; and (b) buckle cap means for co-action with and mounting to said buckle base means; and (c) said buckle base means and said buckle cap means together carrying said securing means for non-removably securing said buckle base means and buckle cap means together into a buckle assembly, said securing means including complimentary snapping securing elements which readily snap together to thereby permanently secure said buckle base means and buckle cap means together and which prevent separation of said buckle base means and said buckle cap means.

2. The buckle assembly of claim 1, wherein said securing means comprises a first securing element in the form of rib means carried by either said buckle base means or said buckle cap means and a second securing element in the form of groove means carried by the other of said buckle base means or said buckle cap means, whichever is not carrying said rib means, said groove means and said rib means being disposed for snap-type co-action one with the other.

3. The buckle assembly of claim 2, wherein at least one of said securing elements is carried by a resilient portion of the buckle base means or buckle cap means, whichever is carrying said securing element, to facilitate said snap-type co-action.

4. The buckle assembly of claim 3, wherein said buckle cap means carries said rib means upon a circumferential wall which surrounds and extends from a top of said buckle cap means and wherein said circumferential wall is sufficiently resilient to surround said buckle base means and enter said groove means.

5. The buckle assembly of claim 4, wherein said buckle cap means is decorated.

6. The buckle assembly of claim 4, wherein said rib means is continuous about the circumferential periphery of said buckle cap means.

7. The buckle assembly of claim 6, wherein said circumferential periphery is circular in peripheral configuration.

8. The buckle assembly of claim 4, wherein said rib means is discontinuous and provides spaced latching elements disposed in spaced relationships about the circumferential periphery of said buckle cap means.

9. The buckle assembly of claim 3, wherein said buckle base means carries said rib means upon a circumferential wall which surrounds and extends from a bottom of said buckle base means and wherein said circumferential wall is resilient.

10. The buckle assembly of claim 9, wherein said buckle cap means is decorated.

11. The buckle assembly of claim 9, wherein said rib means is continuous about the circumferential periphery of said buckle base means.

12. The buckle assembly of claim 11, wherein said buckle base means and said buckle cap means each have a circular peripheral configuration.

13. The buckle assembly of claim 9, wherein said rib means is discontinuous about the circumferential periphery of said buckle base means.

14. The buckle assembly of claim 1, wherein said buckle cap means includes a first buckle cap member and a second buckle cap member which together co-act with said buckle base member to form the buckle assembly.

15. The buckle assembly of claim 14, wherein at least said first buckle cap member carries a securing element in the form of a circumferentially disposed bead or rib and which is positioned to co-act with a predetermined portion of said buckle base means.

16. The buckle assembly of claim 15, wherein said predetermined portion of said buckle base means with which said bead or rib co-acts is a lower peripheral edge of said buckle base means.

17. The buckle assembly of claim 16, wherein said bead or rib is continuous.

18. The buckle assembly of claim 16, wherein said bead or rib is discontinuous and forms a plurality of spaced latching members.

19. The buckle assembly of claim 16, wherein at least a portion of said buckle base means is decorated and said first buckle cap member and said second buckle cap member are each formed with openings through selected portions thereof to facilitate viewing of the decorated portion of said buckle base means.

20. The buckle assembly of claim 19, wherein said second buckle cap member also carries a securing element in the form of a circumferentially disposed bead or rib and which is positioned to co-act with a portion of either said buckle base means or said first buckle cap member.

21. The buckle assembly of claim 20, wherein said first buckle cap member and said second buckle cap member are substantially cup-shaped in configuration.

22. The buckle assembly of claim 21, wherein said bead is a collar disposed about a free end of said cap; said free end, with said collar disposed thereon, is bent inwardly; and said buckle base has a circumferential chamfer for co-action with said collar.

23. The buckle assembly of claim 1, wherein said buckle cap top wall has a centrally disposed threaded opening; and a circularly-shaped design-bearing wall member is threaded into said threaded opening.

24. The buckle assembly of claim 1, further comprising at least one insert member disposed between said buckle base member and said buckle cap member.

25. The buckle assembly of claim 24, wherein said insert member is formed with a circumferentially disposed ring and which is positioned to fix with said buckle cap member.

26. The buckle assembly of claim 25, wherein said buckle cap member includes a pair of spaced circumferentially disposed ribs, one for co-action with said insert member and one for co-action with said buckle base means.

27. The buckle assembly of claim 26, wherein said ribs are each continuous.

28. The buckle assembly of claim 26, wherein at least one of said ribs are discontinuous.

29. The buckle assembly of claim 26, wherein both of said ribs are discontinuous.

30. The buckle assembly of claim 1, including an ornamentation piece and snap means one portion of which is carried by said ornamentation piece and another portion of which is carried by said buckle cap means to mount said ornamentation piece to said buckle cap means.

31. The buckle assembly of claim 1 wherein said securing elements comprise one or more raised chevron shaped wedge members positioned about an internal or external perimeter wall of said buckle cap means or said buckle base means, and oppositely, a plurality of complementary recessed chevron shaped wedge members positioned about an external or internal perimeter wall of said buckle base means or said buckle cap means whichever does not have the raised chevron members, said raised chevron members and said recessed chevron members being capable of a snap-together engagement with one another, which engagement substantially prevents the movement of said buckle cap means with respect to said buckle base means.

32. The buckle assembly of claim 31 comprising a plurality of raised and recessed chevron shaped wedge members disposed in bands positioned about said perimeter walls of said buckle base means and said buckle cap means.

33. The buckle assembly of claim 32 comprising a plurality of raised and recessed chevron shaped wedge members disposed in a plurality of bands positioned about said perimeter walls of said buckle base means and said buckle cap means.

34. The buckle assembly of claim 1 further comprising means for preventing said buckle cap means and said buckle base means from rotating about one another.

35. The buckle assembly of claim 1 further comprising means for preventing said buckle cap means and said buckle base means from moving with respect to the other.

36. The buckle assembly of claim 1 wherein said securing means comprises a circumferential ring around the outer periphery of either said buckle base means or said buckle cap means, and a retainer member being disposed inside the ring and which is held by an edge of the metal ring, said retainer having an annular channel therethrough which has either groove or rib means for cooperation with the complementary buckle cap means or buckle base means.

37. A method of producing a buckle assembly comprising:

(a) providing buckle base means including attaching means for securing said buckle base means to a belt, strap, sash or the like; and (b) providing buckle cap means for co-action with and mounting to said buckle base means; and (c) said buckle base means and said buckle cap means together carrying said securing means for non-removably securing said buckle base means and buckle cap means together into a buckle assembly, said securing means including securing elements which readily co-act to secure said buckle base means and buckle cap means together and which prevent separation of said buckle base means and said buckle cap means; said securing elements comprise one or more raised chevron shaped wedge members positioned about an internal or external perimeter wall of said buckle cap means or said buckle base means, and oppositely, a plurality of complementary recessed chevron shaped wedge members positioned about an external or internal perimeter wall of said buckle base means or said buckle cap means whichever does not have the raised chevron members, said raised chevron members and said recessed chevron members being capable of a snap-together engagement with one another, which engagement substantially prevents the movement of said buckle cap means with respect to said buckle base means; and d) snapping together said buckle base means and said buckle cap means and engaging said complementary recessed and raised chevron members.

* * * * *